United States Patent [19]

Kauserud

[11] Patent Number: 4,549,600

[45] Date of Patent: Oct. 29, 1985

[54] PLANT FOR THE PRODUCTION OF CASTINGS IN A STEPWISE ADVANCED CASTING MOULD CONSISTING OF IDENTICAL, FLASKLESS MOULD PARTS

[75] Inventor: Hakon Kauserud, Ballerup, Denmark

[73] Assignee: Dansk Industri Syndikat A/S, Herlev, Denmark

[21] Appl. No.: 469,984

[22] Filed: Feb. 25, 1983

[30] Foreign Application Priority Data

Mar. 2, 1982 [DK] Denmark ..... 888/82

[51] Int. Cl.[4] ..... B22C 9/20

[52] U.S. Cl. ..... 164/323; 164/130; 164/335

[58] Field of Search ..... 164/322, 323, 335, 130

[56] References Cited

U.S. PATENT DOCUMENTS 3,996,996 12/1976 Gunnergaard ..... 164/323

FOREIGN PATENT DOCUMENTS 2941947 4/1981 Fed. Rep. of Germany ..... 164/335
32829 3/1978 Japan ..... 164/322
101720 8/1979 Japan ..... 164/335
1278265 6/1972 United Kingdom .

OTHER PUBLICATIONS

"Inmold Nodulization with Delayed Pouring in Vertically Parted Moulds", *Modern Casting*, Jul. 1979, by R. Sillen; pp. 58–59.

*Primary Examiner*—Nicholas p. Godici
*Assistant Examiner*—Richard K. Seidel
*Attorney, Agent, or Firm*—Larson and Taylor

[57] ABSTRACT

For the purpose of pouring a stepwise advanced casting mould consisting of identical, flaskless mould parts having vertical joints at which there are provided inlets or chutes extending from the top surface of the mould to its casting cavities, use is made of a pouring tundish having a slitlike bottom outlet adapted to cover three or more inlets temporarily blocked by an obstruction. After an additive has been fed to the tundish this is being filled with the necessary amount of molten iron which prior to removal of the obstruction gets the opportunity of being merged uniformly with the additive, and possible slag products may at the same time rise to the surface. The pouring tundish may meanwhile be advanced one or more steps together with the casting mould while being in firm contact with its top face. After the pouring step has finished the pouring tundish may be disengaged from the casting mould and be returned past the starting position to be fed with additive, and is subsequently ready for a new operation. For a given cycle time of the plant, the period available for the pouring operation may be considerably extended, thereby entailing quality improvements in the produced castings.

6 Claims, 6 Drawing Figures

PLANT FOR THE PRODUCTION OF CASTINGS IN A STEPWISE ADVANCED CASTING MOULD CONSISTING OF IDENTICAL, FLASKLESS MOULD PARTS

FIELD AND BACKGROUND OF THE INVENTION

The invention relates to a plant for the production of castings in a casting mould stepwise advanced through a pouring and cooling path or guideway and consisting of identical, flaskless mould parts which at each joint of the vertically divided mould provide a casting gravity comprising a chute or inlet which is open at the top side of the mould and during the stepwise advance thereof gets into and out of communication with a bottom outlet of a pouring tundish located above the mould.

Such a plant is for instance disclosed in U.S. Pat. No. 3,996,996 according to which the pouring tundish is held stationary on the stepwise advanced casting mould so that the filling of the pouring cavities is performed automatically, as their inlets coincide successively and one at a time with the bottom outlet of the pouring tundish. To ensure such a coincidence the pouring tundish may, however, be adjustable in the longitudinal direction of the pouring track or guideway and possibly also in the transverse direction thereof.

When pouring an ordinary (grey) cast iron the said pouring tundish is frequently applicable with a fully satisfactory result, but in some cases it may require extra care to avoid slag inclusions in the castings.

The pouring tundish is also applicable in the production of castings of alloyed, seeded and/or nodularised cast iron, that actually requires one or more additives to be added to the molten iron, but then an extra chamber should be provided within the proper casting mould, said chamber being in connection with the pouring cavity inlet and allowing the molten iron and additive to merge or at least to start merging. Otherwise, i.e. if the additive is added in the ladle from which the pouring tundish is being filled, an optimum output of the additive cannot be reckoned on, firstly because the additive gets time to oxidize or evaporate before the moment of the proper pouring, secondly because varying periods of time between the addition and the pouring process may give rise to uncontrollable quality losses as to the castings.

In the production of nodularised castings the use of a particular reaction or processing chamber within the proper casting mould is for instance disclosed in GB-patent No. 1,278,265, and in an article "Inmold Nodulization with Delayed Pouring In Vertically Parted Moulds" by R. Sillen (modern casting/July 1979, page 58–59), a modification of said method is disclosed for use in connection with casting moulds of the above mentioned, special type. According to this modification there is, as far as each pouring cavity is concerned, at the top of the casting mould provided a basin, the volume of which equals the volume of metal needed to fill the casting or pouring cavity and from the bottom of which the inlet extends. The basin is being filled from a processing or reaction chamber, in which the needed amount of additive is at first fed following which the molten iron is being poured. At this time the bottom outlet of the basin is closed by a melting disc and the poured iron with additive from the reaction chamber is thereby temporarily retained in the basin, viz. until the disc has melted. During this "stay period" impurities and slag products can rise to the surface, thereby preventing them from following the cast metal down into the mould cavity during the proper pouring that is effected after the disc has melted and, moreover, the flow of the metal from the open basis may be quiet and without interruption so as to avoid air bubbles in the castings.

According to the article referred to the plant is capable of producing 360 moulds per hour corresponding to a cycle time of 10 sec. This, however, makes heavy demands on the necessary aids for feeding the melting discs, for supplying the additive to the reaction chamber and for pouring the molten iron and, therefore, great investments of the plant must be counted on. It is further considered a disadvantage that the reaction chamber and the basin occupy a certain capacity of the casting mould, thereby restricting the size or number of pouring cavities at each of its joints. It should also be mentioned that a certain volume of metal is retained in the reaction chamber and so represents a loss similar to that caused by the runner and ingate system.

SUMMARY OF THE INVENTION AND PREFERRED EMBODIMENTS THEREOF

The plant according to the invention differs from the prior art in that the bottom outlet of the pouring tundish is constituted by a slit elongate in the longitudinal direction of the mould and adapted to cover at the same time at least three successive inlets which are temporarily obstructed, and that the pouring tundish from a filling position is movable together with the casting mould until the pouring has been effected after removal of the obstruction and, subsequently, is movable backwards at any rate to the filling position in order to cover the following set of obstructed inlets.

This eliminates the need for processing or reaction chambers in the casting mould and, consequently, a greater output per casting mould may be obtained. Moreover, only one dosage per three or even more joints is required instead of one dosage of molten iron and additive for each joint in the mould, opening up the possibility of considerably simplifying the structure of the plant and of facilitating the surveillance of its operation. Moreover, for the same cycle time at least the threefold time is available for each pouring operation, thereby entailing that the cycle time may possibly be reduced to the benefit of the productivity.

The obstruction may for each inlet be constituted by an appropriately heat-resistant plug that is removed by being pulled away at the desired time of pouring, but it is preferably a melting body, for instance a melting disc as mentioned above.

According to the invention it is preferred that the pouring tundish is movable backwards past the filling position into an additive filling position. This makes it particularly easy to survey the feeding of additive that may be placed so as to be optimally merged with the iron during its being poured into the tundish.

As the tundish must have a considerable capacity, for instance from 50 kg up to more tons molten metal it has even when emptied a considerable weight. For this reason it may advantageously be disengageable from the top side of the casting mould during its return movement or stroke. This eliminates the risk of causing damage to the upper face of the casting mould during its movement relative to the bottom face of the tundish, but said two faces may nevertheless be in firm contact from the moment when the additive is being placed till the pouring step has been finished.

DETAILED DESCRIPTION OF THE PREFERRED EMBODIMENT

Figure 1:
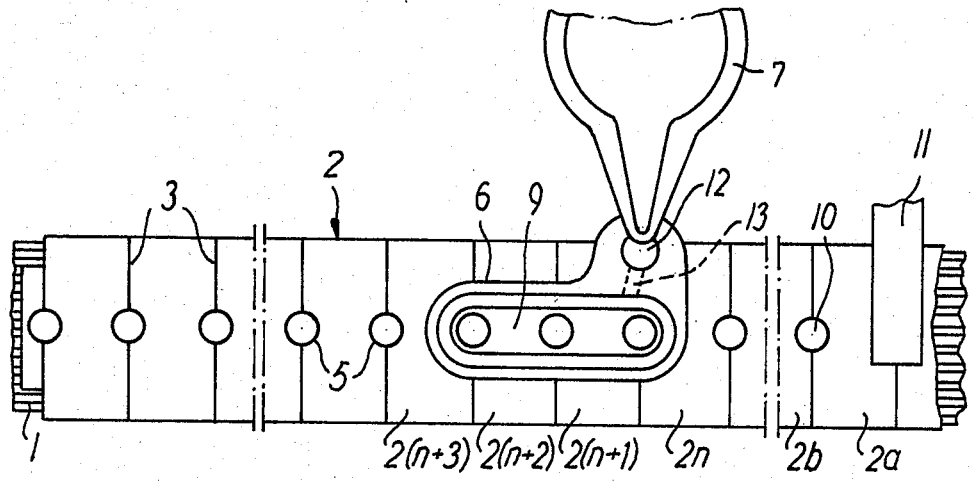
FIG. 1 is a plan view of parts of the pouring and cooling guideway of the plant including the pouring tundish, the ladle and a device for feeding the said melting discs.
Figure 5:
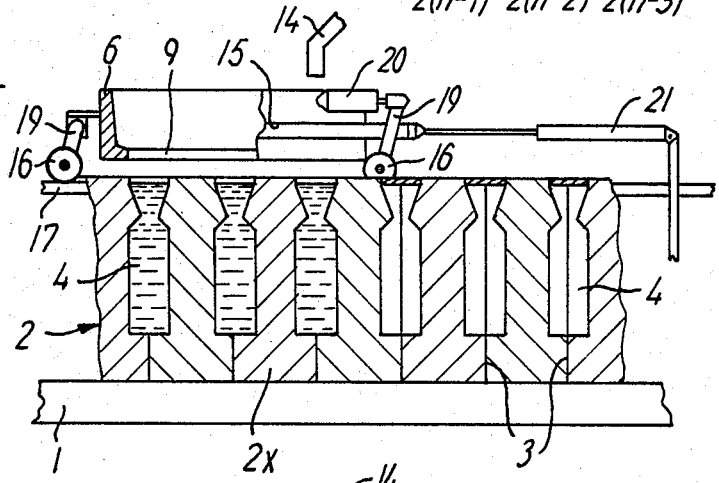
FIGS. 5 and 6 are a longitudinal section and a cross section, resp., showing more details.
Figure 6:
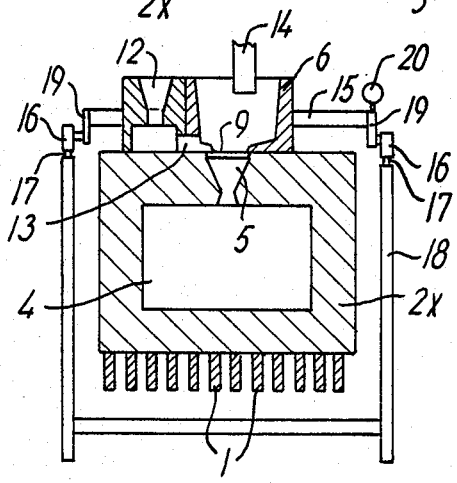

The illustrated plant comprises an ordinary pouring and cooling guideway or bed previously known and consisting of two reciprocal sets of rods or beams, FIGS. 1 and 6. Said rods or beams extend from a device, not shown, for continuous production of identical, flaskless mould parts *2a*, *2b* etc. which concurrently with their production are lined up on the bed 1 and are stepwise advanced thereon in the direction to the left, FIGS. 1 and 5. At each joint 3 each pair of mould parts form a pouring cavity 4 with an upwardly open inlet or chute 5.

Figure 2:
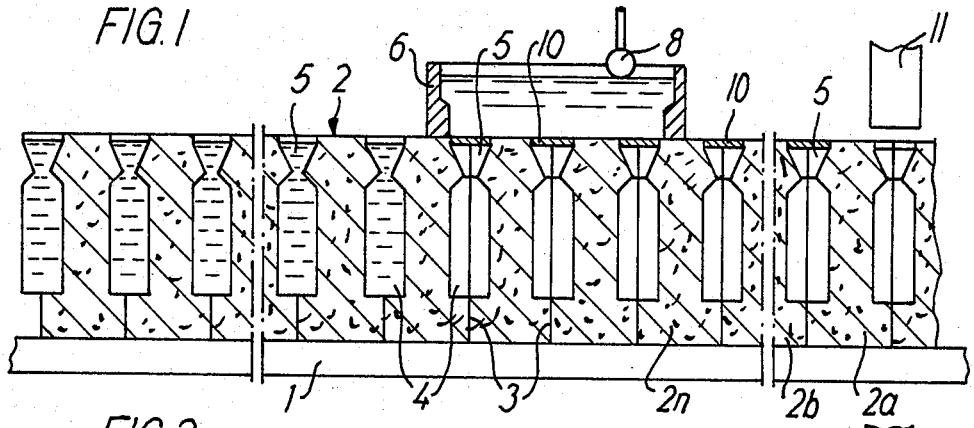
FIGS. 2 to 4 are central, vertical longitudinal sections through the plant in three successive steps during the advancing of the casting mould.
Figure 3:
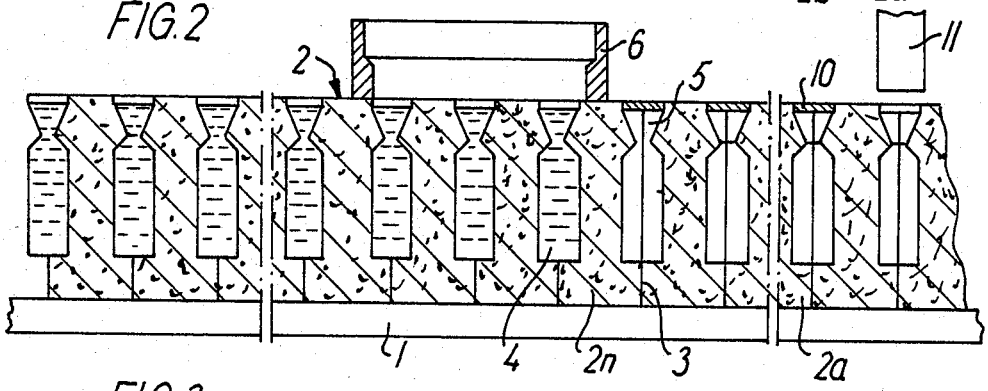
Figure 4:
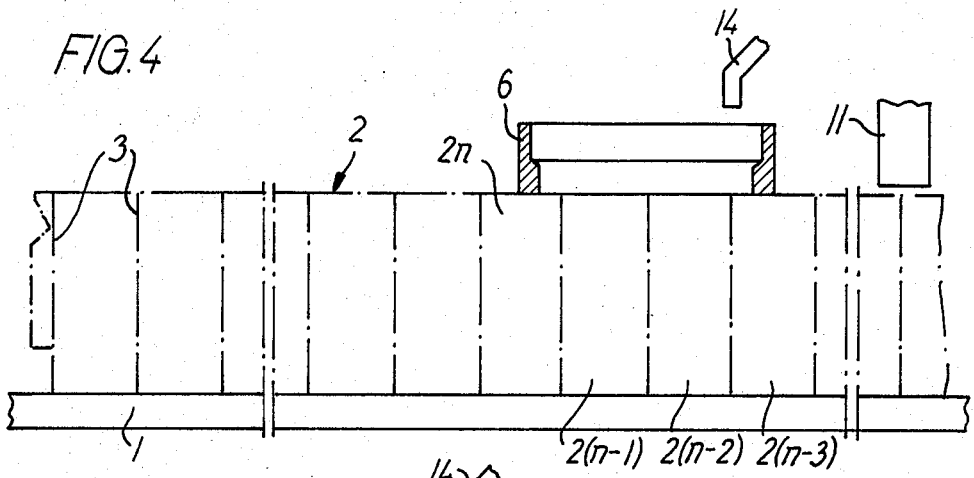

At the pouring station there is above the casting mould 2 positioned a pouring tundish 6 to be filled with molten iron from a ladle 7 or from a melting or heat preservation furnace till a determined level that is controlled by a sensor 8, FIG. 2, or in another way. In the situation disclosed in FIGS. 1 to 4 and 6, the bottom of said tundish is in firm contact with the top surface of the casting mould, and the bottom comprises an outlet 9 elongate in the travelling direction of the mould, said outlet covering three successive inlets or chutes 5, viz. the inlets at the joints between the mould parts $2n$, $2(n+1)$, $2(n+2)$ and $2(n+3)$ in FIGS. 1 to 3. Before said inlets have reached the bottom outlet of the tundish, they have been obstructed by melting discs 10 which may be placed by means of a device 11 not shown in details. Instead of such individual discs there can as well be used fusible sheet covering all the top surface of the casting mould or at least its central stripe presenting the inlets 5.

In FIG. 1 the pouring tundish 6 is supposed to contain the necessary amount of additive, such as an alloying or a nodularizing material, the presence of which can easily be recognized by the operator who is surveying the operation of the plant, and the amount of iron just sufficient to fill the three pouring cavities 4 is poured from the ladle 7 into the tundish 6, appropriately as shown in a cup 12 that is associated through a channel 13 with the reservoir in the tundish. In said reservoir the iron merges with the additive, and possible slag products will rise to the surface. After a certain time, for instance 5 sec., the three discs lying within the area of the outlet slit 9 will melt, thereby opening the inlets 5 so as to cause the total amount of metal to be poured into the three underlying casting cavities 4. This may take place while the casting mould 2 and the pouring tundish 6 resting thereon are being advanced one step into the position in FIG. 3, in which the pouring step has been finished. When the casting mould is subsequently advanced one step, the pouring tundish 6 is at the same time returned past its starting position, FIGS. 1 and 2, onto the position in FIG. 4, in which it is drawn back three times the mould part thickness in relation to the casting mould 2. In this position the pouring tundish thus covers three new inlets 5 and can receive additive through a tube 14, following which it once more accompanies the casting mould through its two next advancing steps, i.e. through the position in FIG. 2 on to the position in FIG. 3.

As shown in FIGS. 5 and 6 the pouring tundish 6 is supported by a frame 15 having wheels 16 running on rails 17 on a supporting rack 18. The wheels 16 are mounted on levers 19 that may be tilted by means of a drive cylinder 20 so that the wheels are supporting only when the pouring tundish 6 shall be moved in relation to the casting mould 2, i.e. be returned to the position in FIG. 3. For this return motion another drive cylinder 21 is provided.

It was mentioned above that the presence of the additive in the pouring tundish prior to pouring iron into it could easily be recognized. This may take place visually or by means of equipments appropriate for the purpose and which in case of failing additive automatically prevents discharge of iron from the ladle 7, and the correct feeding of the melting discs 10 can be analogously surveyed.

I claim:

1. A plant for the production of castings in a casting mould stepwise advanced through a pouring and cooling guideway and of the type consisting of identical, flaskless mould parts which are joined to form vertically divided moulds provided with a casting cavity associated with an inlet which is open at the upper side of the mould, said plant comprising:

an obstruction for the inlets which temporarily covers the inlets;

a tundish located above said guideway having a bottom outlet which is an elongate slit disposed in the longitudinal direction of said guideway and of a size to communicate simultaneously with three successive obstructed mould inlets, said tundish being movable away from a batch filling position by engagement with the upper side of the casting moulds until said obstructions have been removed and the batch pouring has been effected; and a moving means for moving said tundish backwards to the filling position to communicate with a following set of obstructed inlets, said moving means including a means for automatically disengaging said tundish from the upper side of the casting mould during each backward movement of said tundish.

2. A plant as claimed in claim 1 wherein said moving means includes a supporting rack having rails running parallel to the longitudinal direction of the guideway, wherein said tundish includes wheels which engage said rails, and wherein said disengaging means includes levers on which said wheels are mounted such that said wheels support said tundish only when said tundish is moved backwards.

3. A plant as claimed in claim 1 wherein said tundish includes a pouring cup, a reservoir in which said slit is located, and a channel connecting said pouring cup to said reservoir; and further including an additive depositing means for depositing an additive in said tundish prior to filling of said reservoir.

4. A plant as claimed in claim 3 wherein said depositing means deposits the additive in said reservoir.

5. A plant as claimed in claim 1, wherein the obstruction is a melting body.

6. A plant as claimed in claim 1, wherein the pouring tundish is movable backwards past the filling position into an additive filling position.

* * * * *